United States Patent [19]

Scalzo et al.

[11] 4,021,138

[45] May 3, 1977

[54] ROTOR DISK, BLADE, AND SEAL PLATE ASSEMBLY FOR COOLED TURBINE ROTOR BLADES

[75] Inventors: Augustine J. Scalzo, Philadelphia; Richard P. Gunderlock, Chester Township, both of Pa.

[73] Assignee: Westinghouse Electric Corporation, Pittsburgh, Pa.

[22] Filed: Nov. 3, 1975

[21] Appl. No.: 628,450

[52] U.S. Cl. ..... 416/95; 416/218; 416/220 R

[51] Int. Cl.[2] ..... F01D 5/18

[58] Field of Search ..... 416/95, 193 A, 96–97, 416/218, 220, 219 A

[56] References Cited

UNITED STATES PATENTS

| | | | |
|---|---|---|---|
| 2,928,650 | 3/1960 | Hooker et al. | 416/96 |
| 3,266,770 | 8/1966 | Harlow | 416/97 X |
| 3,572,966 | 3/1971 | Borden et al. | 416/95 |
| 3,635,586 | 1/1972 | Kent et al. | 416/95 X |
| 3,689,177 | 9/1972 | Klassen | 416/218 X |
| 3,709,631 | 1/1973 | Karstensen et al. | 416/95 |
| 3,807,898 | 4/1974 | Guy et al. | 416/220 |
| 3,814,539 | 6/1974 | Klompas | 416/95 |
| 3,842,595 | 10/1974 | Smith et al. | 416/95 X |
| 3,853,425 | 12/1974 | Scalzo et al. | 416/95 |

*Primary Examiner*—Everette A. Powell, Jr.
*Attorney, Agent, or Firm*—F. A. Winans

[57] ABSTRACT

The invention comprises sealing structure between a seal plate, a rotor, and a blade, for sealing the root portion of a rotor and blade assembly to provide a sealed chamber adjacent the base of the root into which radially directed passageways in the blade open for transmitting the cooling fluid, delivered to the chamber, through the blade to the tip end thereof to cool the blade. The seal is perfected through a wedging action caused by centrifugal force moving the base or foot of the plate, disposed below the blade root, into sealing engagement with the rotor disk, and an intermediately disposed seal bar extending arcuately just radially outwardly of the radially innermost portion of the root and generally in the vicinity of the innermost loaded root projection with the loaded root providing the axial seal and the sealing bar and seal plate foot providing the radial seals to define a cooling fluid chamber adjacent the base of the root.

4 Claims, 3 Drawing Figures

ROTOR DISK, BLADE, AND SEAL PLATE ASSEMBLY FOR COOLED TURBINE ROTOR BLADES

BACKGROUND OF THE INVENTION

1. Field of the Invention

The present invention relates to a seal plate, rotor disk, and blade assembly for sealing the upstream face of the rotor disk and blade root, and more particularly to the seal plate of such assembly having radially opposed wedging sealing means responsive to centrifugal force to establish a sealed chamber adjacent the blade root.

2. Description of the Prior Art

This invention is closely related to, and comprises an improvement in the seal plate of U.S. Pat. No. 3,572,966 of common assignee. In the referenced patent, the seal plate establishes a chamber generally coextensive with the radial extent of the blade root so that cooling air introduced therein flows axially along the root to cool only the blade root and exit in an aperture in an opposed downstream seal plate.

In the instant invention, it is desirable to cool the blade via a cooling fluid flowing through radial passageways initiating in the blade root and terminating in the blade tip. In order to minimize the leakage of the cooling fluid from the chamber previously defined by the sealing plate, which chamber generally enclosed the entire blade root to pass the cooling fluid thereby, a smaller or radially shorter chamber is now desirable, being only sufficiently extensive to inclose that area of the root containing the inlets to the blade cooling passageways. In this regard, the inlets to the passageways are in the radially innermost area of cusp of the root and that space between the cusp and the adjacent disk area defines a chamber into which the passageways open. Thus, it is necessary for the outermost seal of the seal plate to be effective at a position radially outwardly of this area between the blade root and the disk, however, the closer such seal can be made to this area the less opportunity there is for a leak to exist.

SUMMARY OF THE INVENTION

The present invention provides a seal plate disposed on a rotor disk and in sealing engagement therewith to provide a cooling fluid chamber between the radially innermost portion of the root of the blade and the disk. Each plate is retained in radially opposed annular grooves on the disk receiving the outer and inner edges of the plate. The inner groove defines an axial angled shoulder mating with a complementary axial angled projection on the lower edge of the plate such that the radially outward movement of the plate as urged by centrifugal force cams the face of the plate adjacent the inner edge into abutting sealing engagement with the mating face of the disk. The upper edge is received for guided radial movement in a groove of generally close tolerances. The disk is dished axially in the area generally covered by the plate to define a cooling fluid chamber therebetween, with cooling fluid directed to the blade root therethrough. However, to minimize cooling fluid leakage from between the plate and the opposed adjacent surfaces the plate, the surface facing the disk defines an arcuately extending channel having sides extending to general adjacent the surface of the disk. The radially outermost side of the channel slants upwardly toward the disk. A seal bar is disposed generally loosely within the channel across the arcuate extent thereof. Thus, under centrifugal force, the seal bar is moved radially outwardly and axially inwardly toward the disk to establish a sealing wedging engagement therewith. Such sealing engagement is preferably located at the innermost loaded root projection which provides an axial seal to establish a cooling fluid chamber subadjacent the cusp of the root. The blade contains radially directed openings extending from the cusp to the blade tips so that cooling fluid through the openings to cool the blade with minimal leakage losses.

DESCRIPTION OF THE PREFERRED EMBODIMENT

This invention is an improvement of the structure described and claimed in U.S. Pat. No. 3,572,966 which is herein incorporated by reference for such description. Thus, in this instance, FIG. 1 of the present description is similar to FIG. 1 of the referenced patent except that the feature of the improvement has been added. The reference numbers given the various structural components herein will be the same as those identifying identical structure in the referenced patent, and this identical structure will thus not be described in detail.

Figure 1:
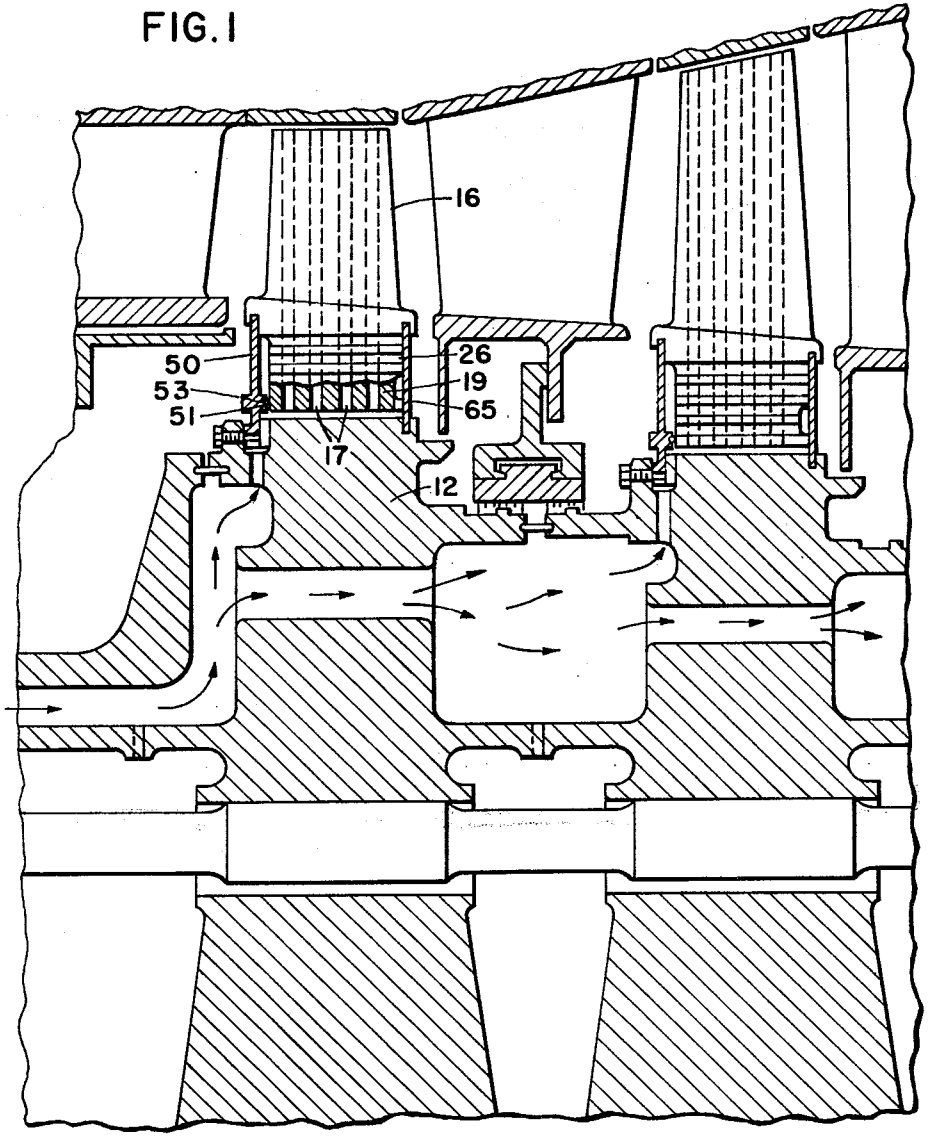
FIG. 1 is a longitudinal sectional view of the bladed portion of an axial flow turbine having rotor disks and seal plates constructed and assembled in accordance with the present invention.

Referring to FIG. 1, it should be immediately pointed out that the rotor blade 16 is cooled throughout its radial extent by radially extending passageways 17 passing through the blade from the tip thereof to the radially innermost portion of the root 26 which will be referred to as the cusp 19. Also, in this regard, to force the flow of the cooling fluid radially as opposed to the axial direction desired in the referenced patent, the downstream seal plate 65 is solid and does not have an aperture therein.

It is also seen that the upstream seal plate 50 of the present invention includes an intermediate channel 51 opening axially toward the common face of the blade root 26 and rotor disk 12. The diverging sides of channel 51 provides a lower generally axially projecting side 51*a* and an upper side 51*b* (see FIG. 2) projecting upwardly axially to define a camming surface. The opposed sides 51*a* and 51*b* converge in a generally rounded contour at their juncture in the seal plate. A sealing rod 53 of generally circular cross-sections is disposed within the channel 51 and captured therein by the opposing face of the disk and blade.

Figure 2:
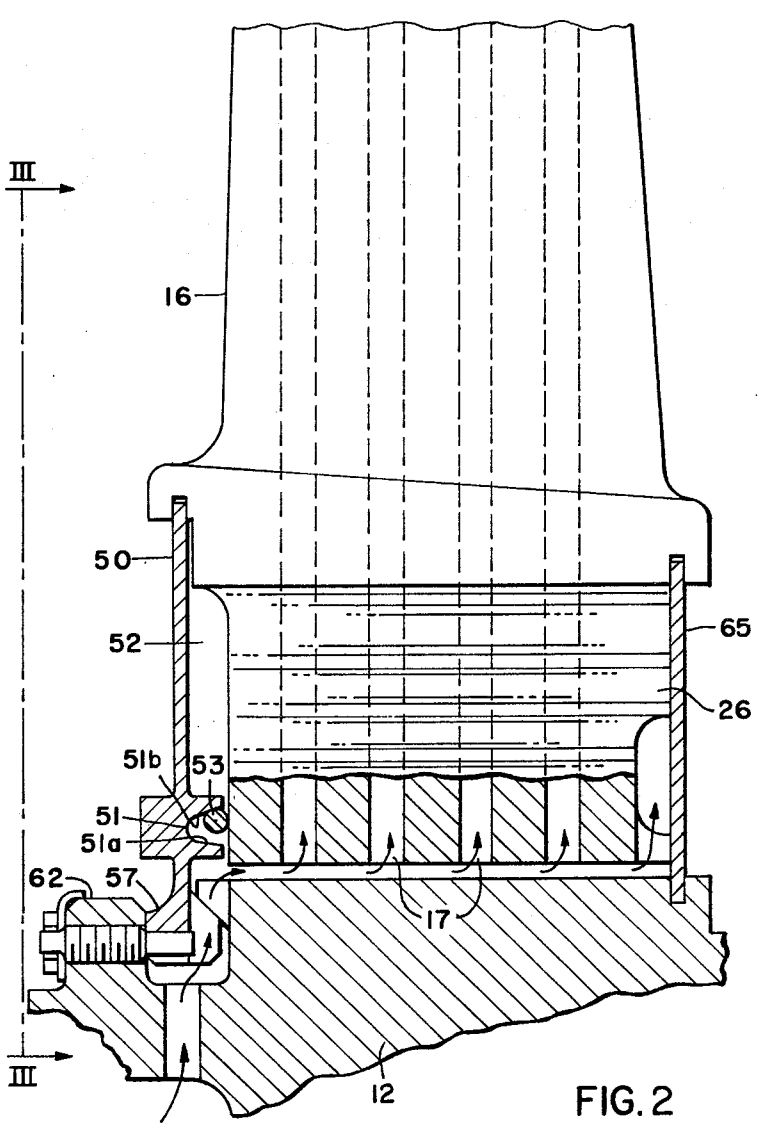
FIG. 2 is an enlarged portion of FIG. 1.

Referring now to FIG. 2, the relative positions of the various parts are shown under operating conditions. In such condition, as previously explained in the referenced patent, the seal plate 50 is cammed into a sealing engagement with the ledge 62 of the disk 12 in the area of the radially innermost edge or foot 57 of the plate. In a like camming action under the influence of centrifugal force, the seal rod 53 moves radially upwardly and inwardly and is wedged in sealing engagement along the common planar surface of the disk and blade roots facing the rod. Thus, a cooling fluid chamber 52 radially sealed at the radially inner edge as before, but sealed in an intermediate position by the wedging of the seal rod 53 against the upstream face of the disk and blade root, is shown.

Figure 3:
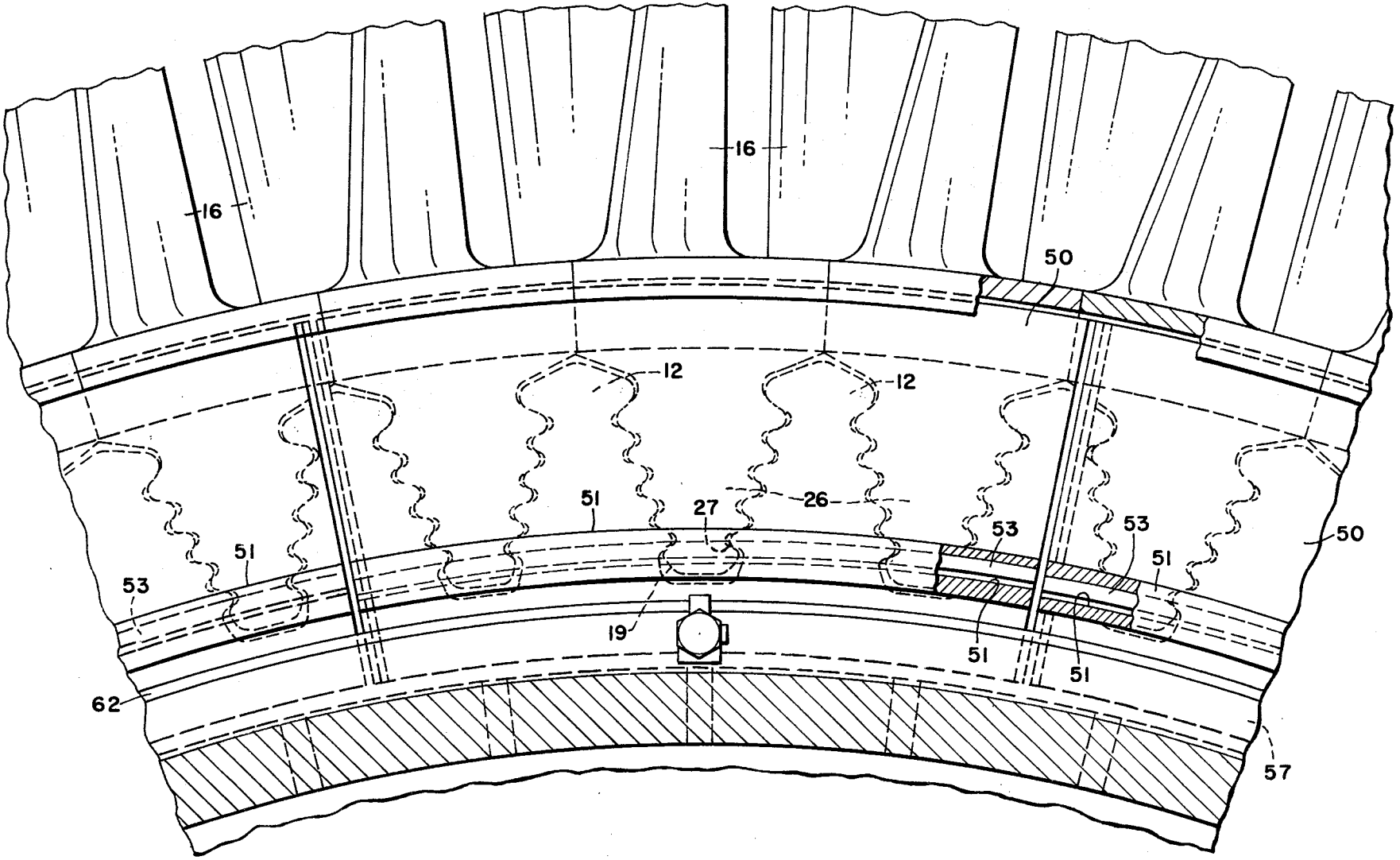
FIG. 3 is a view taken generally along lines III—III of FIG. 2.

Referring now to FIG. 3, it is seen that the channel 51 extends generally arcuately across the arcuate extent of the plate 50 and at a radial dimension generally corresponding to the radially innermost loaded root projection as at 27 which is defined as that projection of the fir-tree root 26 which is in loaded engagement with a mating contour of the disk 12. This occurs in the vicinity of the arcuate line A—A as seen in FIG. 3. Thus, this engagement of the loaded root projection 27 by the disk 12 establishes the radially innermost axial seal therebetween and defines a chamber between the cusp 19 of the root and the adjacent surface of the disk. By having the radial seals provided by the plate existing along an arc radially inwardly of this chamber, i.e. the foot portion 57 of the plate providing this seal, and just radially outwardly of the first loaded root engagement and radially inwardly of the next space existing between the root and the disk through the seal bar 53, thereby confines the cooling fluid chamber 52 to a rather small space, reducing the opportunities for escape or leakage and providing seals that react in response to centrifugal force to establish a positive seal.

As a further feature, it will be noted in FIG. 3 that the terminal ends of the channel 51 and thus the terminal ends of the seal bar 53 are at distinctly different radial dimensions. This staggering of the ends prevents circumferential shifting of the bars 53 from one channel to the channel of the next adjacent plate 50 without the necessity of an indexing pin to hold them in such position. However, the amount of radial difference is insufficient to change the above described relative sealing position of the bar with respect to the loaded root projection.

We claim as our invention:

1. A rotor disk, blade, and seal plate assembly for an axial flow fluid machine wherein said assembly defines a sealed cooling fluid chamber between the root of said blade and said disk, and wherein said blade is mounted in said disk through a fir-tree blade root configuration defining a series of projections which under centrifugal force engage complimentary projections on said disk to provide a plurality of sealing engagements therebetween along the axial extent of said disk and said blade and first sealing means sealing said chamber radially inwardly of said blade root, and second sealing means for sealing said chamber radially outwardly of said first sealing means;

said first sealing means comprising complementary angled surfaces on said disk and said seal plate whereby centrifugal force moves the seal plate axially into sealing engagement with said rotor disk radially inwardly of said blade root; and, said second sealing means comprises means on said seal plate defining a camming surface facing said adjacent rotor disk and blade root and movable means disposed adjacent said camming surface for engagement therewith under the influence of centrifugal force to be moved axially into sealing engagement between said surface and said rotor disk and blade root radially outwardly but closely adjacent the radially innermost point of said plurality of sealing engagements.

2. As assembly according to claim 1 wherein said camming surface comprises the radially outer surface of an axially open groove on the surface of said plate facing said rotor disk and said movable means comprises a rod freely disposed within said groove and captured therein by said adjacent rotor.

3. An assembly according to claim 2 wherein said groove and rod are substantially coterminous and extend generally arcuately across the extent of said plate.

4. An assembly according to claim 3 wherein the root receiving portion of said rotor is covered by a plurality of said plates disposed in abutting relationship with each other and wherein the adjacent ends of the groove and enclosed rod of abutting plates are at distinctly different radial dimensions from the axis of the disk whereby rods from adjacent grooves are prevented from displacement out of their respective seal plate.

* * * * *